US005131464A

United States Patent [19]

Lenhart et al.

[11] Patent Number: 5,131,464

[45] Date of Patent: Jul. 21, 1992

[54] RELEASABLE ELECTRICAL WET CONNECT FOR A DRILL STRING

[75] Inventors: Robert A. Lenhart, Cypress; Allen K. Rives, Houston, both of Tex.

[73] Assignee: Ensco Technology Company, Houston, Tex.

[21] Appl. No.: 710,621

[22] Filed: Jun. 5, 1991

Related U.S. Application Data

[63] Continuation-in-part of Ser. No. 586,467, Sep. 21, 1990, abandoned, and a continuation-in-part of Ser. No. 665,877, Mar. 7, 1991.

[51] Int. Cl.[5] ..... E21B 23/00

[52] U.S. Cl. ..... 166/65.1; 439/190

[58] Field of Search ..... 166/65.1, 66, 77, 250; 175/40, 45; 439/626, 567, 581, 190, 191, 271, 332

[56] References Cited

U.S. PATENT DOCUMENTS 4,767,349 8/1988 Pottier et al. ..... 166/65.1 X 4,921,438 5/1990 Godfrey et al. ..... 439/190

*Primary Examiner*—Thuy M. Bui

*Attorney, Agent, or Firm*—Fulbright & Jaworski

[57] ABSTRACT

A connectable and releasable electrical wet connect for transmitting electrical signals in a well drill string includes retrievable coacting telescoping male and female member electrical connectors. The male member includes a support shoulder for supporting the wet connect in the drill string, a passageway for the flow of fluids, an electrical contact, a tapered and insulating seal and a fishing shoulder. The female member includes a telescopically engageable electrical receptacle, and a tapered and insulating female seal. The wet connect telescopically connects and disconnects in the drill string and electrically isolates the electrical signal transmitted through the wet connect from the fluid in the drill string.

9 Claims, 5 Drawing Sheets

FIG.2
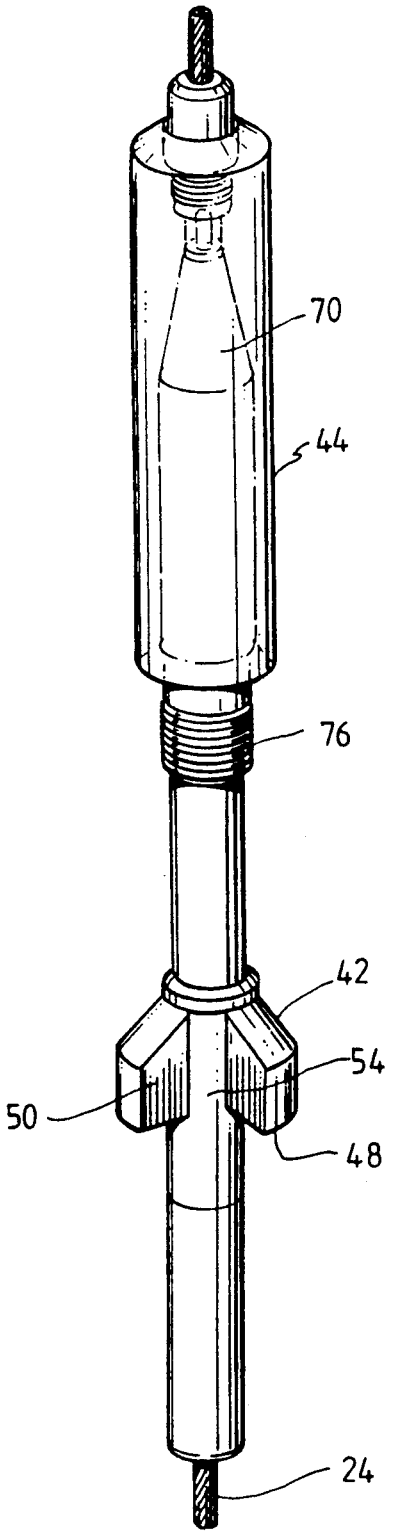
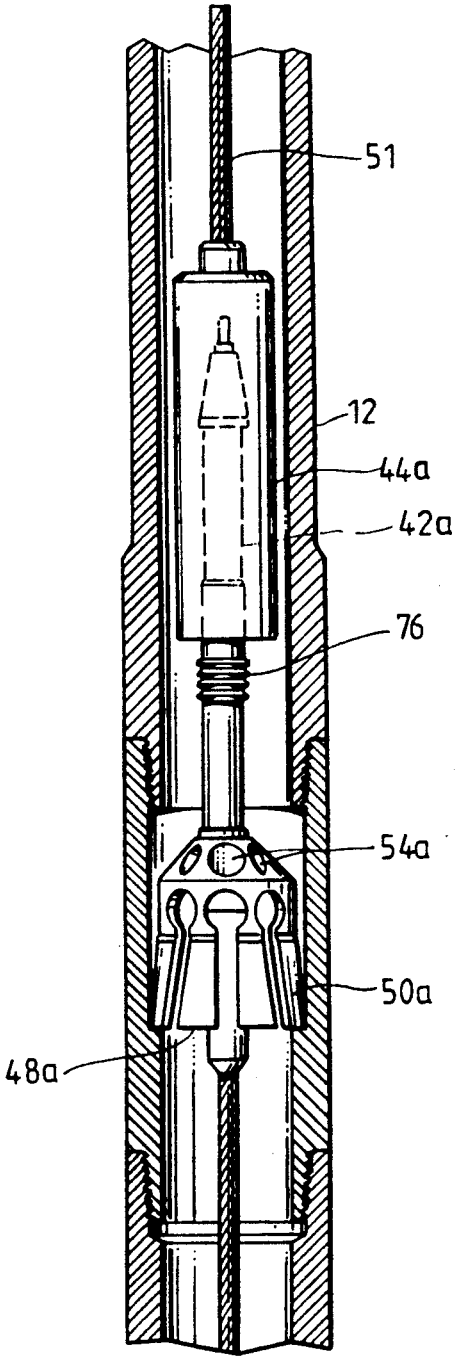
FIG.3

RELEASABLE ELECTRICAL WET CONNECT FOR A DRILL STRING

CROSS-REFERENCE TO RELATED APPLICATION

This application is a continuation-in-part of application Ser. No. 07/586,467, filed Sep. 21, 1990, entitled "Electrically Conducting and Orientation Signal in a Directionally Drilled Well", now abandoned, and application Ser. No. 07/665,877, filed Mar. 7, 1991, entitled "Electrically Conducting an Orientation Signal in a Directionally Drilled Well".

BACKGROUND OF THE INVENTION

Drilling directional and/or horizontal wells requires the use of a survey tool, referred to as a steering tool, to monitor the well bore path and monitor the orientation of the drilling assembly. One method of transmitting the survey information required to measure the orientation of the drill bit and well bore path is by use of an electrical conductor connected between the steering tool and the well surface for conducting signals.

Horizontal or high angle well bores, unlike conventional vertical well bores, are used to drill long well bore intervals in the target pay zone. As a result, many horizontal wells are drilled live (producing oil/gas) which requires the use of blowout control equipment at the well surface and around the outside of the drill string. This requires that the electrical conductor conducting signals from the steering tool to the well surface be inside of the drill string.

In directional and/or horizontal drilling, steerable drilling motors or rotary drilling assemblies are used to drive a drill bit to drill a controlled well path. This technology requires a combination of drill string rotation and slide drilling to control the direction and inclination of the drill path. Conventional wireline steering techniques prevent drill string rotation while the steering tool is downhole and connected through an electrical conductor to the well surface. Pulling the electrical conductor and/or steering tool for string rotation is not always economical or achievable in high angle and horizontal drilling due to seating problems. These problems are further magnified as the wireline electrical conductor from the well surface to the steering tool must be lengthened or shortened as additional pipe joints are added to or subtracted from the drilling string as drilling continues. This creates additional problems of support of the electrical conductor in deep wells.

The present invention is directed to the use of a connectable and releasable electrical wet connect for use in a wireline electrical conductor, such as used for transmitting electrical signals through a well drill string. In particular, a steering tool is used to monitor tool face orientation and to survey the well path in directional and/or horizontally drilled wells. The present wet connect can be telescopically connected and disconnected in the drill string as required, as the drill string is lengthened and shortened. When connected, the present wet connect electrically isolates the transmitted power or electrical signal from electrical ground and from the drilling fluid. This allows free electric communication between the steering tool and the surface support equipment. In addition, drill string rotation for steerable drilling assemblies is not hampered by the electrical conductor and wet connect due to its construction and operation. Furthermore, because of the present wet connect, the wireline electrical conductor may be quickly positioned so as not to interfere with the addition to or the subtraction of pipe joints to the drill string.

SUMMARY

The present invention is directed to a connectable and releasable electrical wet connect for transmitting electrical signals in a well drill string and includes a retrievable coacting telescoping male and female member electrical connectors. The male member includes a support shoulder for supporting the wet connect from a shoulder in the drill string and a passageway for the flow of fluids through the drill string. The male member also includes an upstanding electrical contact extending through the male member for connection to and support of an electrical conductor. A tapered and insulating seal is positioned below the electrical contact and a fishing shoulder is provided for the removal of the male member from the drill pipe. The female member includes a telescopically engageable and releasable electrical receptacle for coacting with the electrical contact. The female member also includes a tapered and insulating female seal positioned below the electrical receptacle for coacting with the seal on the male member for electrically insulating the receptacle and contact when they are engaged from fluid in the well string.

A still further object of the present invention is wherein the female member includes an outer metal jacket surrounding the tapered and insulating seal and the electrical receptacle in the female member. Preferably, a lower metal seal is threadably connected to the outer jacket and abuts and secures the female seal within the outer jacket.

A still further object of the present invention is wherein a compression seal washer is positioned between a shoulder on the electrical receptacle and a shoulder on the interior of the outer jacket for sealing on compression. Additional or substitute seals can be provided, such as an O-ring seal, between the female seal and the outer jacket and an O-ring seal between the female seal and the electrical receptacle.

Still a further object of the present invention is wherein the male member includes a ring for centralizing the lower end of the female member.

Yet a further object of the present invention is wherein the male member may include a threaded exterior section for use with a surface overshot.

Still a further object of the present invention is wherein the support shoulder on the male member includes a plurality of downwardly and outwardly directed rigid fingers in one embodiment, and in another embodiment the support shoulder includes a plurality of downwardly and outwardly directed spring fingers.

Other and further objects, features and advantages will be apparent from the following description of presently preferred embodiments of the invention, given for the purpose of disclosure, and taken in conjunction with the accompanying drawings.

BRIEF DESCRIPTION OF THE DRAWINGS

FIG. 2 is an enlarged perspective elevational view of the wet connect of the present invention, FIG. 3 is an enlarged, fragmentary, elevational view of another embodiment of the wet connect of the present invention.

BRIEF DESCRIPTION OF THE PREFERRED EMBODIMENTS

The present invention of the wet connect for transmitting electrical signals in a well drill string will be described in connection with its use in monitoring a steering tool in directional drilling applications, for purposes of illustration only. However, it is to be understood that the present connectable and releasable wet connect can be used to conduct other types of electrical signal and power through drill pipes in other applications.

Figure 1C:
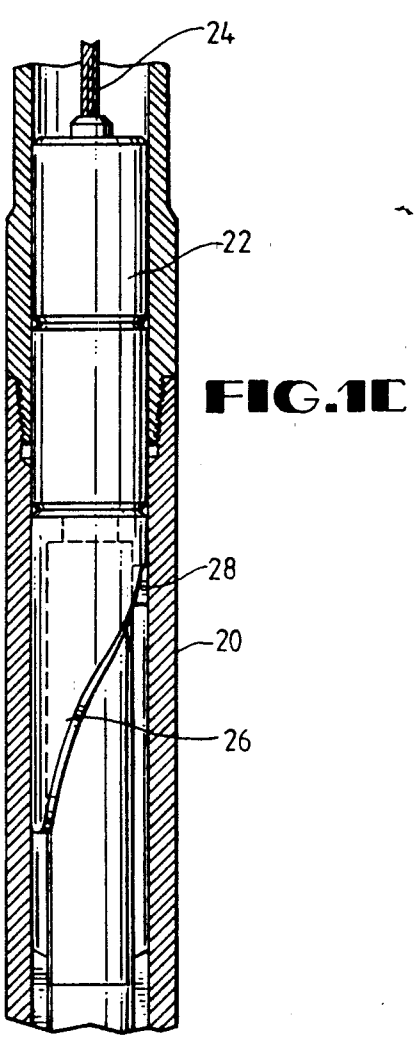
FIG. 1C is a continuation of FIG. 1B.
Figure 1B:
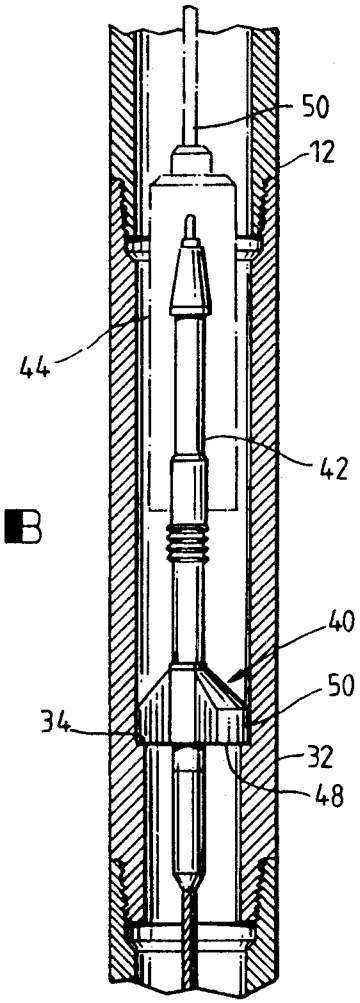
FIG. 1B is an enlarged, fragmentary, elevational view, partly in cross section, of a portion of the drilling string of FIG. 1A.
Figure 1A:
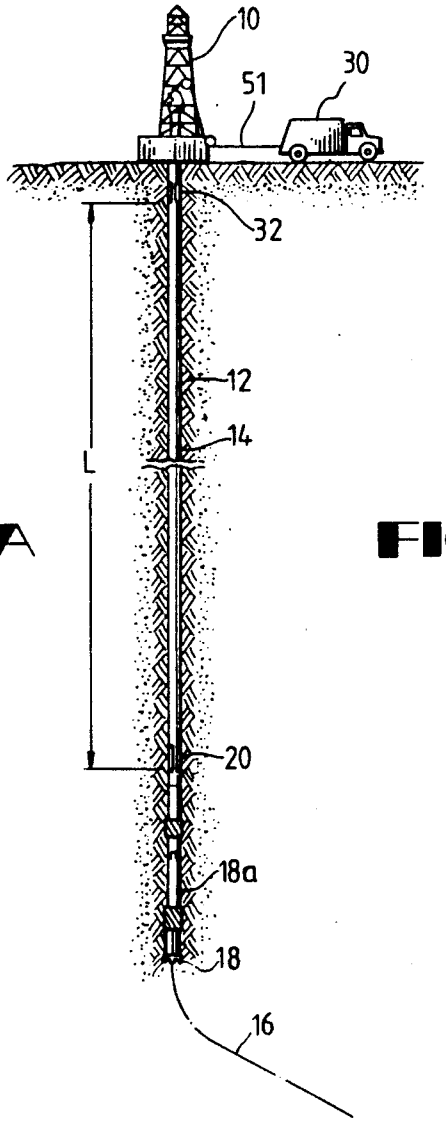
FIG. 1A is a schematic, elevational view, illustrating the beginning of drilling a directional and/or horizontal well.

Referring now to the drawings, and particularly to FIG. 1A, a drill rig 10 is shown for operating a drill string 12 for drilling a well bore 14. As shown, the well bore 14 is generally vertical, but as indicated by the broken line 16, the further direction of the drill string 12 is nonvertical, and may be horizontal. As shown in FIG. 1A, the drilling bit 18 is just above the location where the oriented/steerable drilling is to start. In order to drill a directional path 16, a conventional downhole fluid drive motor or steerable motor **18*a* includes a drill bit 18 and is actuated by the flow of fluid down the inside of the drill string 12. The axis of the bit 18 is offset from the axis of the well bore 14. The offset drill bit 18 can also be used for drilling a straight bore 14 by continuously rotating the drill string 12 until the directional correction is required. At that time, rotation of the drill string 12 is then stopped, the steerable fluid motor 18*a* is oriented in the required direction, and the drilling continues along the path 16 by fluid actuation of the motor 18*a* driving the bit 18. One suitable downhole motor is offered by Trudril. In order to drill an oriented hole, the drill string 12 includes an orienting sub 20 (FIG. 1A and 1C) which is rotatably aligned with the steerable drilling motor 18*a*. A conventional wireline steering tool 22 (FIG. 1C) such as offered by Tensor, is lowered on an electrical conductor 24 and seated in the orienting sub 20. Conventionally, a muleshoe 26 is used which is connected to tool 22 and orients the tool 22 relative to a key 28. The muleshoe 26 may be either a latching or a nonlatching type. Thus the muleshoe 26 orients the steering tool 22 relative to the steerable motor 18*a***. The above described apparatus and method is generally conventional.

The present method and apparatus is directed to the improvement in connecting the electrical conductor 24 between the steering tool 22 and a wireline measurement unit 30 located at the well surface.

A cable head landing sub 32 (FIGS. 1A and 1B) having a shoulder 34 may be included in the drill string 12. In order to transmit electrical signals between the steering tool 22 and the measurement unit 30, one or more connectable and releasable electric wet connects generally indicated by the reference numeral 40, consisting of a male member 42 and a female member 44 (FIGS. 1B, and 2–6) are utilized.

The male member 42 includes a body 46 and a support shoulder 48, which may be formed by a plurality, such as three downwardly and outwardly directed fluted support legs 50, for seating on a shoulder, such as shoulder 34, in the drill string 12, for supporting the cable 24, which has a length L, for example, 6000 feet and also supports the steering tool 22 during running. Preferably, the fluted legs 50 are attached to the body 46 by a threaded connection 52. A passageway 54, such as the openings between the legs 50, allow circulation of well fluids through the drill pipe 12.

The male member 46 includes an upwardly directed, preferably tapered on the top, electric contact 56 which extends by a rod 58 through lower insulator 60, which is made of an insulating material, such as Ultem, and is used to centralize and seal the lower end of the electrical rod 58. The body 46 is preferably metal, and thus an insulator 62 is used between the rod 58 and the body 46. Suitable seals, such as O-rings 64, may be used to seal out drilling fluid. A lower rope socket connector 66, which may be made from high strength steel, includes internal threads 68 for accepting a conventional rope socket electrically connected to the electrical conductor 24 for electrically and mechanically attaching a length of conventional single or multiple conductor wireline.

The male member 46 includes a tapered and insulating seal which is positioned below the electrical contact 56 and may be made of any suitable insulating material, such as Ultem. The tapered seal 70 coacts with a coacting seal in the female member 44 which will be described more fully hereinafter.

The male member 46 may also include fishing shoulder 72 which allows a standard collet type fishing overshot to be used to latch on to the male member 46 to retrieve it from the drill string 12 along with any attached conductor cable 24 and/or steering tool 22.

In addition, the male member 46 may include a centralizing ring 74, which may be fluted, and is used to centralize the lower end of the female member 44 to minimize vibration, misalignment, and insure good electrical contact and sealing between the male and female members 42 and 44. In addition, the male member 42 may also include a threaded section 76 which is used to attach to a surface overshot to facilitate surface handling, as this provides an easier structure for handling than the fishing shoulder 72 when at the well surface.

Figure 4:
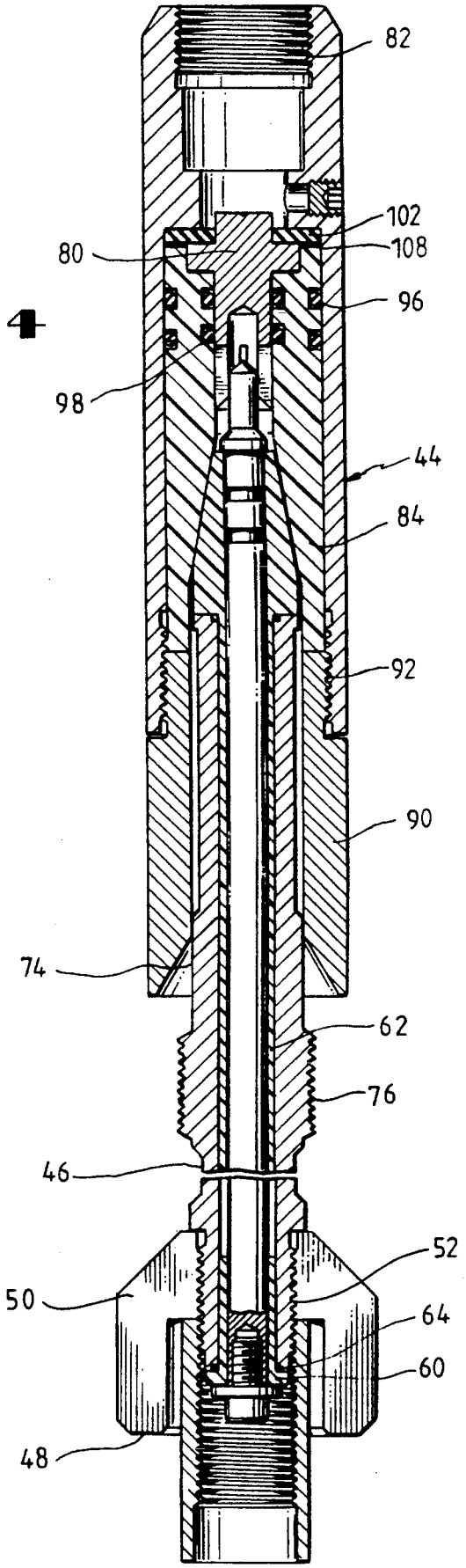
FIG. 4 is an enlarged, elevational view, in cross section, of the wet connect of FIG. 2 shown in the connected position.
Figure 5:
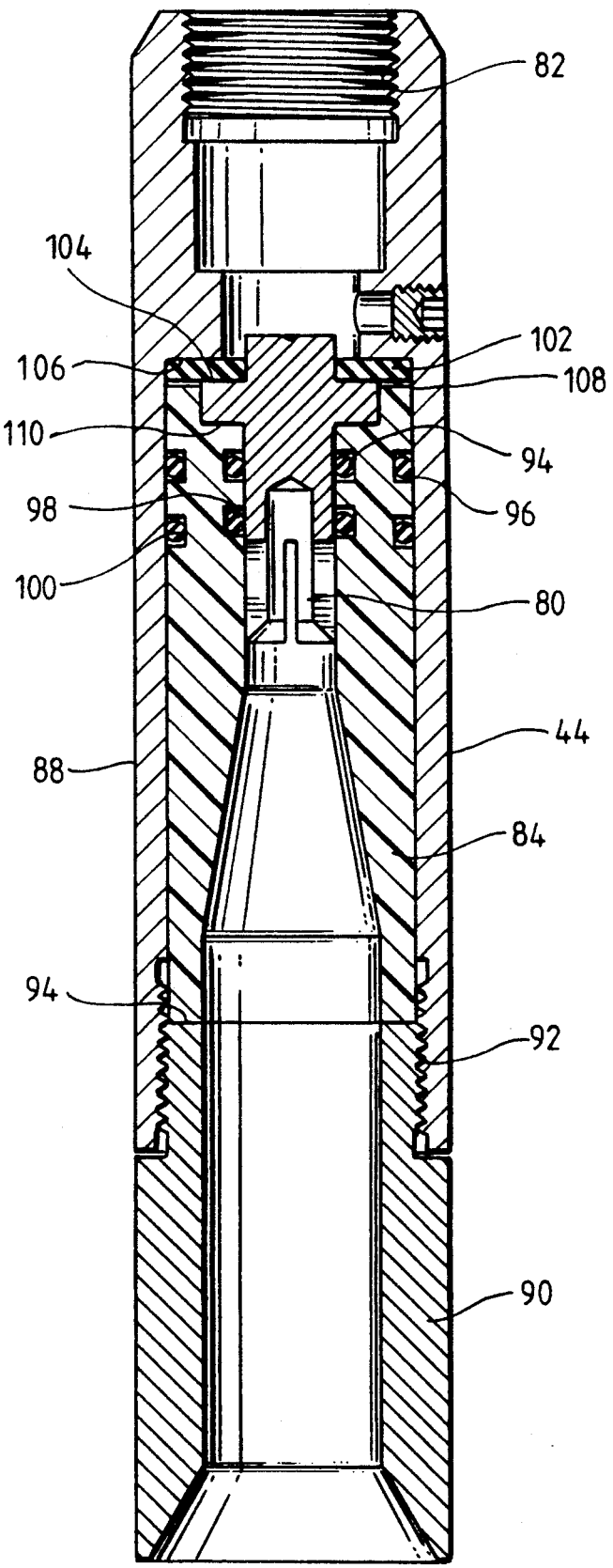
FIG. 5 is an enlarged, elevational view, in cross section, of the female member of the connector shown in FIG. 4.
Figure 6:
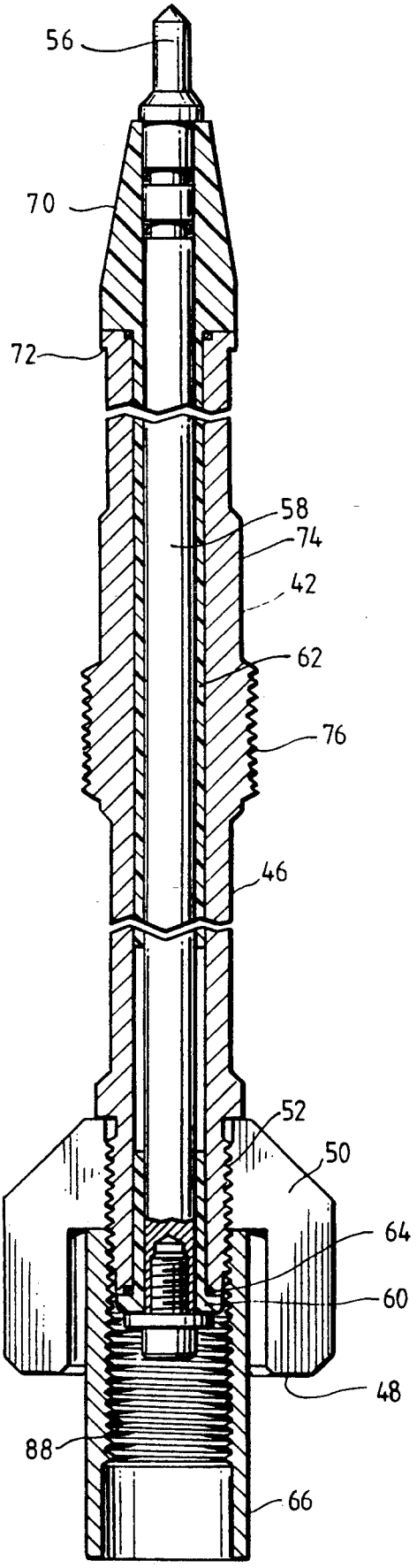
FIG. 6 is an enlarged, elevational view, in cross section, of the male member of the connector of FIG. 4.

Referring now to the female member electrical connector 44, it includes an electrical receptacle 80 which may be constructed out of an electrical conducting material, such as stainless steel. The receptacle 80 makes a telescopically engageable and releasable engagement with the electrical contact 56 of the male member 42 (FIG. 4). Preferably, the lower portion of the electrical connector 80 includes a split skirt design creating a spring action to insure good electrical contact with the contact 56. The female member 44 may be run into the drill string 12 on conventional single or multiconductor wireline having at least one electrical conducting strand surrounded by multistrand of wire for protection and strength. The member 44 includes a connector 82 for receiving a conventional rope socket, such as a titan head, which may include a weight bar, if necessary, to assist in the engagement of the male member 42 and female 44. The connection 82 makes an electrical connection between the attached wireline conductor and the electrical receptacle 80.

The female member 44 includes a tapered and insulating female seal 84 having a tapered surface such as conical surface for coacting with the tapered insulating seal 70 of the male member 46. The coacting seals 84 and 70 coact to create an electrical seal isolating the mated electrical contact 56 and receptacle 80 from shorting to ground either through drilling fluid or metal components. Preferably, dielectric grease may be applied inside of the seal 84 to assist in sealing. A further function of the tapered shape of the seals 84 and 88 is to align and hold the two members 42 and 44 in place and prevent vibration and movement during circulation of the well fluid through the drill string 12 when the members 42 and 44 are engaged. Still a further purpose of the tapered shape of the seals 70 and 84 is to assist in their alignment when they are being engaged. Yet another function is to create an aerodynamic shape on top of the male connector 42 that will assist in minimizing cavitation and erosion around the upper part of the connector 42 as well as be selfcleaning to prevent drill cuttings or other suspended solids in the drilling fluid from preventing proper seating of the female member 44. It is to be noted that the sealing surfaces between the seals 84 and 70 need not be sealed along their entire length, but need to be circularly sealed on at least one coacting portion in order to electrically isolate the engaged contacts 56 and 80 from the drilling fluid. In order to insure and maintain a secure seal, the seals 84 and 70 must be maintained in engagement in spite of drilling vibration or movement therepast of drilling fluids, therefore, there is structural alignment and support for maintaining the seals 70 and 84 in engagement. The female member 44 includes an outer metal jacket 88 which provides a backup support for the seal 84 and is preferably of a high strength steel or stainless steel. In addition, a lower jacket 90 is threadably secured by threads 92 to the outer jacket 88 and includes a shoulder 94 for abutting, supporting, and applying compression to the seal 84. Because of this, the seal 84 is securely held in place inside the outer jacket 88. In addition, the lower jacket 90 coacts with the centralizing ring 74 on the male member 42 to centralize the lower end of the female member 44 to minimize vibration, misalignment and insure good electrical contacting and sealing between the members 42 and 44.

Well fluids are sealed out of the upper end of the female member 44 by the use of interior O-ring seals 94 and exterior O-ring seals 96, and, if desired as a backup, additional interior O-ring 98 and exterior O-ring 100. In addition, a compression washer 102 is provided between a shoulder 104 on the electrical receptacle 80 and a shoulder 106 on the interior of the outer jacket 88. It is to be noted that there is a slight space between the upper end 108 of the seal 84 and the washer 102, but that the upper end of the seal 84 engages a shoulder 110 on the electrical receptacle 80. Therefore, when the lower jacket 90 is threadably tightened in the outer jacket 88 and applies a compressive force on the tapered seal 88, the compression washer 102 is also placed in compression and so acts as a backup seal for the O-rings 94, 96, 98 and 100.

It is noted in FIG. 2 that the downwardly and outwardly fixed legs 50 are rigid for supporting the electrical cable 27 and the steering tool 22 from a coacting shoulder in the drill string 12, such as shoulder 34. The outside diameter of the legs 50 are sized to allow it to pass through the drill string, both downwardly for seating, and upwardly for retrieval from the drill string 12.

Referring now to FIG. 3, another embodiment of the present invention is seen wherein like parts to those in the other figures are similarly numbered with the addition of the suffix "a". In this embodiment, instead of rigid legs 50, the members **50*a* are downwardly and outwardly directed spring fingers which include a shoulder 48*a* for supporting the male member 42*a* and any connected equipment therefrom from a shoulder in the drill string 12. However, the spring fingers 50*a* are sized to spring inwardly, thus allowing the male member 42*a* to be pulled uphole, but will not slide downhole. Inbetween the fingers 58*a* are flow passages 54*a* to allow passage of drilling fluid through the drill string 12. The flexible fingers 50*a* are used when the drill string 12 or tool joint inside diameter restricts the use of a rigid support legs 50 which would have to have an inside diameter similar to the outside diameter of the steering tool 22. The flexible fingers 50*a* will rest directly on a tool joint shoulder, such as 34**, or in a groove in a conventional sub or drill pipe.

As described in the above mentioned patent applications, the male connector is designed to be wireline retrievable and designed to be able to be used as either a primary connector or an intermediate connector. The male member **42*a* with the flexible fingers 50*a* is designed to be used as an intermediate connector in the drill string 12 since the support ring inside diameter will have to be large enough to allow passage of the lower rigid support legs 50**.

In operation, as described in the aforementioned patent applications, the steering tool 22 is lowered on the cable 24 and seated and the male member 42 with the rigid legs 50 is seated on a shoulder 30 supporting the cable 24 and steering tool 22. Thereafter, a conductor wire 50 is lowered into the drill string 12 and includes the female member 44 which is adapted to coact with the male member 42 to provide a retrievable, telescoping, sealable, and waterproof electrical connection. The upper end of the conductor wire 50 is run upwardly through the interior of the drill string 12 and telescopically through a non-rotatable connection through the drill string and to the wireline unit 30. When additional joints of pipe are to be added to the drill string 12, the female member 42 may be retracted allowing the addition of additional pipe joints to be connected and thereafter telescopically reconnected to the male member 42. In the event that the depth becomes sufficient, additional segments of electrical conductors will be placed in the drill string having a female member 44 on the bottom and telescopically and sealably engage the top another male member, such as **42*a*. Thereafter, the electrical conductor 50 and a female member 44 will coact with the upstanding male member 42*a*** for transmitting electrical signals.

In tripping out of the drill string 12, the top female member 44 is pulled upwardly to the upper end of the drill string 12. Thereafter, an overshot is lowered into the drill string 12 engaging the fishing shoulder 72 on the male member 42 for removal of the male member 42 and any equipment connected thereto.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, will be readily apparent to those skilled in the art and which are encompassed within the spirit of the invention and the scope of the appended claims.

What is claimed is:

1. A connectable and releasable electrical wet connect for transmitting electrical signals in a well drill string comprising, retrievable coacting telescoping male and female members electrical connectors, said male member including, a support shoulder for supporting the wet connect from a shoulder in the drill string, a passageway for the flow of fluids through the drill string, an upstanding electrical contact extending through the male member for connection to and support of an electrical conductor, a tapered and insulating seal positioned below the electrical contact, a fishing shoulder for removal of the male member from the drill pipe, said female member including, a telescopically engageable and releasable electrical receptacle for coacting with the electrical contact, a tapered and insulating female seal positioned below the electrical receptacle for coacting with the seal on the male member for electrically insulating the receptacle and contact when they are engaged from fluid in the drill string.

2. The wet connect of claim 1 wherein the female member includes, an outer metal jacket surrounding the tapered and insulating seal and the electrical receptacle in the female member.

3. The wet connect of claim 2 including, a lower metal jacket threadably connected to the outer jacket and abutting and securing the female seal within the outer jacket.

4. The wet connect of claim 3 including, a compression seal washer positioned between a shoulder on the receptacle and a shoulder on the interior of the outer jacket.

5. The wet connect of claim 3 including, an O-ring seal between the female seal and the outer jacket, and an O-ring seal between the female seal and the electrical receptacle.

6. The wet connect of claim 1 wherein the male member includes, a ring for centralizing the lower end of the female member.

7. The wet connect of claim 1 wherein the male member includes, a threaded exterior section for use with a surface overshot.

8. The wet connect of claim 1 wherein the support shoulder on the male member includes a plurality of downwardly and outwardly directed rigid legs.

9. The wet connect of claim 1 wherein the support shoulder includes a plurality of downwardly and outwardly directed spring fingers.

* * * * *